United States Patent [19]

Söderlund

[11] 4,171,150

[45] Oct. 16, 1979

[54] MOUNTABLE STORAGE FURNITURE

[75] Inventor: Bengt Söderlund, Stockholm, Sweden

[73] Assignee: AB Gustavsberg, Gustavsberg, Sweden

[21] Appl. No.: 891,028

[22] Filed: Mar. 28, 1978

[30] Foreign Application Priority Data

Apr. 4, 1977 [SE] Sweden ..... 7703938

[51] Int. Cl.[2] ..... A47B 87/00

[52] U.S. Cl. ..... 312/107; 312/111; 312/257 R; 312/263; 312/297

[58] Field of Search ..... 312/107, 108, 111, 140, 312/263, 257 R, 257 SK, 297; 220/23.4

[56] References Cited

U.S. PATENT DOCUMENTS

| | | | |
|---|---|---|---|
| 1,740,888 | 12/1929 | Davidson | 312/297 |
| 2,769,679 | 11/1956 | Wiseman | 312/263 |
| 3,410,441 | 11/1968 | Rhyne | 312/263 |
| 3,460,878 | 8/1969 | Peterson et al. | 312/297 |
| 3,722,971 | 3/1973 | Zeischegg | 312/107 |
| 3,822,924 | 7/1974 | Lust | 312/108 |
| 3,836,217 | 9/1975 | Shiina | 312/107 |
| 4,021,089 | 5/1977 | Bush | 312/111 |
| 4,043,477 | 8/1977 | Deese | 312/111 |

*Primary Examiner*—Victor N. Sakran

*Attorney, Agent, or Firm*—Toren, McGeady and Stanger

[57] ABSTRACT

A kit composed of a plurality of parts capable of being assembled without tools into a cubical cabinet includes four wall panels made of injection molded plastic which may be joined together to form four sides of a six sided cubical cabinet. Each of the four wall panels is formed with connecting devices extending along two of the sides of the panels with the connecting devices of each panel engaging the connect-devices of another panel to join the panels together. The panels in the kit also include securing devices formed on the same sides of the panels as the connecting devices. A torsionally rigid rear panel is adapted to engage each of the four assembled wall panels to form a real wall for the cubical cabinet and the kit is also provided with a front closure member which may be assembled to form the front of the cabinet.

5 Claims, 4 Drawing Figures

MOUNTABLE STORAGE FURNITURE

BACKGROUND OF THE INVENTION

This invention refers to an easily-assembled cabinet consisting of four identical sides of injection moulded plastic, a torsionally rigid back and a front closing device.

In homes, and to a far greater extent in offices, there is a need for storage furniture in the form of cabinets. Such furniture is traditionally made of wood and, for the needs of the latter, to some extent sheet-metal. The sides of wooden cabinets have been made of sheets of core-board or plywood joined together at the edges. For the past 20 years, the sides of an increasing number of cabinets have been made of chipboard. In all cases, problems have arisen in joining the sides together at the corners, the solution of which has always been costly in terms of labour. This applies both to the old-fashioned method of dovetailing as well as to the method of mortising and glueing the chipboard sides together. For the latter method, the chipboard sides must be of a certain thickness, usually 19 mm, with predrilled holes for centre pins passing through the face of one of the chipboard elements into the edge of the other. This work calls for a degree of precision that can only be achieved with multi-spindle machines. All the above methods of joining are only suitable for use in a factory, since joining necessitates glueing the parts together and clamping them in position.

A complement to the aforementioned methods which permits transportation of the kind of furniture in question in compact, i.e. knocked-down, form is employed. In this connection assembly screws and threaded insert sleeves are used for which predrilling must be carried out with the consequent difficulty of aligning the free edges of the sides in the same plane. Added to this, the person assembling the cabinets must have access to certain tools, usually a screwdriver or hexagonal-spanner.

A considerable disadvantage of chipboard is that it has a coarse and comparatively delicate surface. Even the furniture grades have surfaces that require a covering coat of paint. In addition, the structure of the edges is such that they must always be covered with mouldings. The appearance and abrasion resistance of the chipboard is improved by veneering the surfaces. Such procedure entails an extra cost element.

Added to this, grooves for louvres or sliding doors must be milled in the chipboard when manufacturing cabinets. Such grooves then have to be lined with plastic mouldings so that the necessary front closing devices can be operated without abrading the soft internal parts of the chipboard.

The production of storage furniture in plastic is known but such furniture is then made in the form of volume units. They consist chiefly of parallelepiped units that are injection moulded in one piece with five surrounding sides and the front equipped with a closing device in the form of a door or cover. Such items of furniture require a special insert in order to support shelves, trays, bins and other fittings. Neither is it possible to make internal grooves in the cabinet material itself for a front closing device such as a roller shutter. However, the real disadvantage of this type of storage furniture is that in larger sizes the units require considerable manufacturing space and entail high transportation costs.

The purpose of the present invention is to obviate the above-mentioned disadvantages and to achieve a storage cabinet made of side elements of injection moulded plastic which can be assembled by the user in a simple manner without tools. It should be possible to fit interior fittings and front closing devices directly to the assembled sides.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

SUMMARY OF THE INVENTION

Briefly, the present invention may be described as a kit composed of a plurality of parts which are capable of being assembled together without the use of tools in order to form therefrom a cubical cabinet comprising four wall panels made of injection molded plastic adapted to be joined together to form four sides of a six sided cubical cabinet; connecting devices extending along two sides of each of said panels, the connecting devices of each of said panels being adapted to engage the connecting devices of another panel to join said panels together; fixing securing devices formed on the same sides of each of said panels as said connecting devices adapted to be joined together simultaneously with interengagement of said connecting devices; a torsionally rigid rear panel adapted to simultaneously engage each of said four panels to form a rear wall for said cubical cabinet; and a front closure member for said cabinet adapted to be mounted in operative relationship with at least two of said four wall panels.

DETAILED DESCRIPTION OF THE PREFERRED EMBODIMENT

Figure 1:
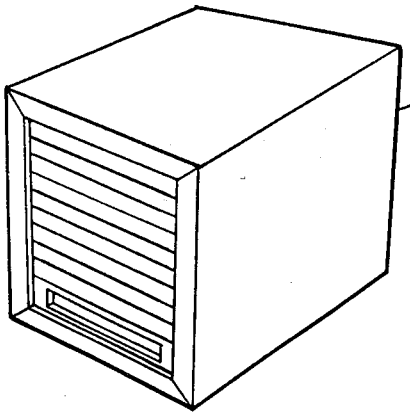
FIG. 1 is a perspective view of an essentially cubical cabinet assembled in accordance with the present invention and fitted with a roller shutter as a front closure device.
Figure 2:
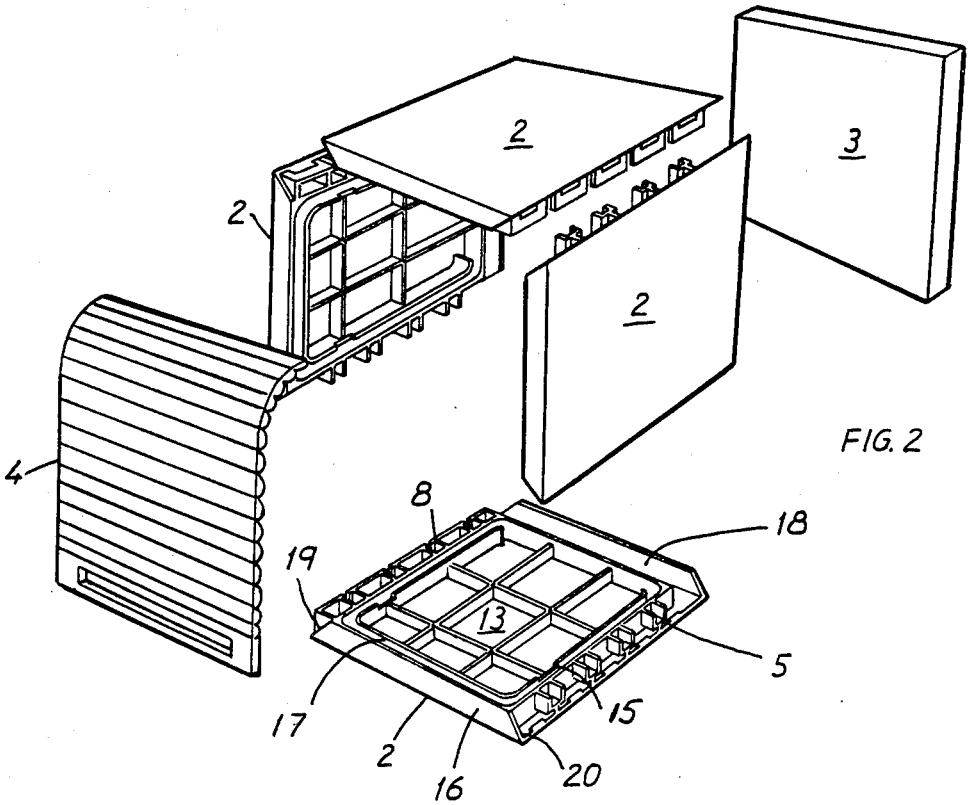
FIG. 2 is an exploded perspective view of the principal components forming the kit of the present invention from which the cabinet depicted in FIG. 1 may be assembled.
Figure 3:
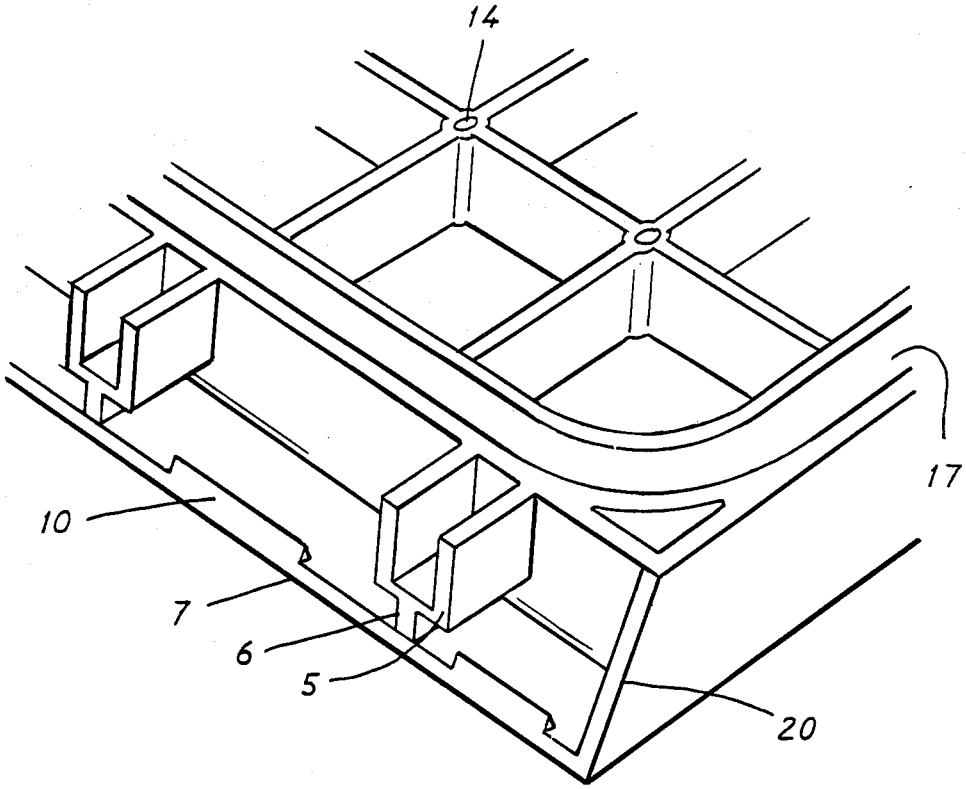
FIGS. 3 and 4 are perspective views showing in greater detail parts of the elements depicted in FIG. 2.
Figure 4:
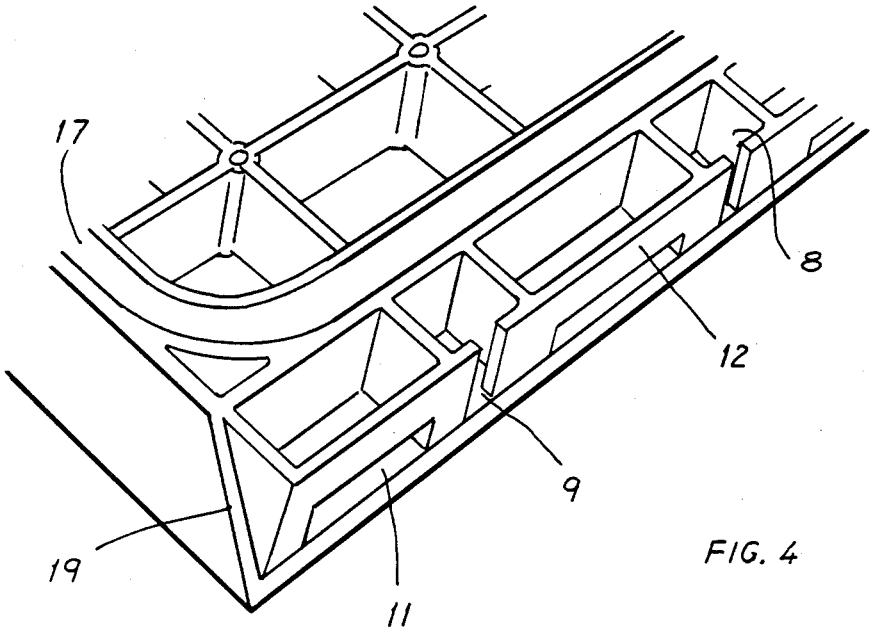

A storage cabinet 1 consists of four identical parts 2 of injection moulded plastic which in the following will generally be called side elements, although only two of them are really sides while the other two serve as top and bottom respectively. Also included in cabinet 1 is a back 3, preferably of a torsionally rigid material such as board or chipboard, and a front closing device here exemplified by a roller shutter 4. Side elements 2 are designed with connecting devices 5, 8 along two of their edges, the symmetrical axes of which are oriented in two planes essentially at right angles to each other. The connecting devices are of male and female type respectively. Male connecting devices 5 may be of several different shapes but in the example shown a square-section tube with one side omitted has been chosen. This male connecting device 5 is, by means of spring 6, connected to the outside 7 of side element 2. Female connecting devices 8 are of corresponding shape to male devices 5, and in consequence they also are of rectangular cross section. Further, female devices 8 incorporate slots 9 for accepting the springs 6. Through this arrangement and due to the extremely good surface finish that can be obtained with injection moulded plastic, which also permits close tolerances between the male and female devices 5 and 8, excellent location and good stability between the assembled side elements is obtained.

For the purpose of locking the two side elements 2 to each other when joined together, they are provided with lips 10 and corresponding openings 11 in the wall tongues 12 joining the female connecting devices 8. Consequently, the lips 10 are situated along the edge of side element 2, where the male connecting devices 5 are arranged. On assembling two side elements 2, the lips 10 press wall tongues 12 in slightly at the same time as the parts of the outside 7 located between the springs 6 are pressed out slightly. Due to the elasticity of the plastic material, the male connecting devices 5 can consequently be pressed down into female connecting devices 8 and when they reach bottom the lips 10 snap into the openings 11 and lock the two side elements 2 to each other. Since the lips 10 press against the wall tongues 12, the slots 9 are slightly expanded and this facilitates joining the connecting devices 5, 8 together. When the lips 10 have snapped into the openings 11, the slots 9 spring back and a press fit is obtained between female connecting devices 8 and male connecting devices 5.

In order to enable interior fittings to be fastened to the inside of side elements 2, they incorporate a polygonal latticework 13 with preferably round holes 14 formed at their intersections. Fastening devices for shelves, glide rails for trays or drawers, or expansion fittings for suspension files or other fittings can be mounted in these holes with a sliding fit. The latticework 13 gives side elements 2 the necessary ridigity and results in a considerable saving of material. Specially profiled pockets 15 can be arranged in latticework 13 immediately adjacent to the connecting devices 5, 8. These pockets are designed to accept the ends of sheet-metal profile mouldings, which reinforce long cabinets horizontally.

Along both edges of the side elements 2 with connecting devices 5, 8 and inside these devices and along an intermediate edge 16, which comprises the front edge of the element, is a groove 17. This constitutes the locating groove for roller shutter 4. Along the fourth edge of side element 2 is a groove 18 into which the rear panel 3 is fitted on assembly of the cabinet 1. The front edge 16 of side element 2, which is at right angles to its outside 7, is of the same height as latticework 13 and is chamfered at 45° at both ends 19, 20 in order to provide cabinet 1 with a neat front frame.

Assembly of the cabinet is carried out by assembling the side elements 2 in pairs. Afterwards the rear panel 3 is inserted into the groove 18 of one of the side element pairs, after which the other side element pair is slid sideways towards and into the first pair of sides until the two rows of lips 10 snap into the corresponding openings 11. The roller shutter 4 is introduced diagonally rolled-up into the cabinet 1 as far as rear panel 3. Since latticework 13 is somewhat lower, the rolled-up roller shutter can be turned horizontally and inserted into roller shutter groove 17. Afterwards the interior fittings desired for various purposes can be fitted in holes 14. Since the fastening devices, which are not shown, are manufactured to make a sliding fit into holes 14, the interior fittings can be repositioned to suit varying requirements.

With side elements which are of the same size, are identical and display bilateral symmetry, one size of cabinet can be obtained. With side elements of two lengths, three sizes or four versions can be assembled since the intermediate size may be of maximum length either horizontally or vertically. With side elements of three lengths, nine versions of the cabinets can be produced, and practically all storage furniture requirements in the office sector can thereby be satisfied.

Side elements 2 can of course be made with connecting devices of male or female type only, whereby the top and bottom parts of cabinet 1 are provided with connecting devices of the opposite type only.

While a specific embodiment of the invention has been shown and described in detail to illustrate the application of the inventive principles, it will be understood that the invention may be embodied otherwise without departing from such principles.

I claim:

1. A kit composed of a plurality of parts capable of being assembled without the use of tools into a cubical cabinet comprising four wall panels made of injection molded plastic adapted to be joined together to form four sides of a six sided cubical cabinet, connecting devices extending along two sides of each of said panels, the connecting devices of each of said panels being adapted to engage the connecting devices of another panel to join said panels together, fixing securing devices formed on the same sides of each of said panels as said connecting devices adapted to be joined together simultaneously with interengagement of said connecting devices, a torsionally rigid rear panel adapted to simultaneously engage each of said four walls to form a rear wall for said cubical cabinet, and a front closure member for said cabinet adapted to be mounted in operative relationship with at least two of said four wall panels, said connecting devices being structured to include male and female members, said male members cooperating to engage said female members with a press fit, with each of said wall panels being structured to have integrally formed on one edge thereof connecting devices comprising male members and on an opposite edge thereof connecting devices comprising female members, and with said securing devices being formed on said one edge to comprise lips and on said opposite edge to comprise openings adapted to have said lips engaged therein with a snap fit.

2. A kit according to claim 1 wherein said male and female devices comprising said connecting devices are arranged alternatively along the edges of said wall panels.

3. A kit composed of a plurality of parts capable of being assembled without the use of tools into a cubical cabinet comprising four wall panels made of injection molded plastic adapted to be joined together to form four sides of a six sided cubical cabinet, connecting devices extending along two sides of each of said panels, the connecting devices of each of said panels being adapted to engage the connecting devices of another panel to join said panels together, fixing securing devices formed on the same sides of each of said panels as said connecting devices adapted to be joined together simultaneously with interengagement of said connecting devices, a torsionally rigid rear panel adapted to simultaneously engage each of said four walls to form a rear wall for said cubical cabinet, and a front closure member for said cabinet adapted to be mounted in operative relationship with at least two of said four wall panels, said wall panels having sides thereof comprising the insides of said cabinet to be formed, said sides of said wall panels being designed as polygonal lattice work within which there are arranged holes at points of intersection, said holes being adapted to accommodate therein fastening devices for enabling mounting within said cabinet of optional interior fittings by means of a sliding fit.

4. A kit according to claims 1 or 3 wherein said front closure member comprises a roller shutter adapted to be fitted in continuous grooves arranged to extend along at least three of the edges of at least two of said wall panels.

5. A kit according to claim 1 or 3 wherein each of said wall panels is formed to include an integrally formed concealing edge extending between the edges of said wall panels on which said connecting devices are formed, said concealing edge being arranged to form a front edge of said cubical cabinet when said kit is in assembled condition and extending to a height sufficient to conceal from view said connecting devices, said concealing edge being chamfered at its ends at an angle of 45°.

* * * * *